US005085829A

United States Patent [19]

Ishii et al.

[11] Patent Number: 5,085,829

[45] Date of Patent: Feb. 4, 1992

[54] OXIDATION RESISTANT FE-CR-AL STEEL

[75] Inventors: Kazuhide Ishii, Shimizu; Hiroshi; Tatsuo Kawasaki, both of Chiba, all of Japan

[73] Assignee: Kawasaki Steel Corporation, Japan

[21] Appl. No.: 632,058

[22] Filed: Dec. 21, 1990

[30] Foreign Application Priority Data

Dec. 25, 1989 [JP] Japan ..... 1-332632
Feb. 23, 1990 [JP] Japan ..... 2-41101

[51] Int. Cl.[5] ..... C22C 38/06; C22C 38/18
[52] U.S. Cl. ..... 420/79; 420/81
[58] Field of Search ..... 420/79, 81

[56] References Cited

U.S. PATENT DOCUMENTS 4,870,046 9/1989 Yamanaka et al. ..... 420/81

FOREIGN PATENT DOCUMENTS 58-93856 6/1983 Japan ..... 420/79
1002057 8/1965 United Kingdom ..... 420/79

*Primary Examiner*—Deborah Yee
*Attorney, Agent, or Firm*—Austin R. Miller

[57] ABSTRACT

An oxidation-resistant Fe-Cr-Al steel, having superior workability, oxidation resistance at high temperature and corrosion resistance, has a composition which contains: up to but not more than about 0.05 wt % of C; about 0.1 to about 1.0 wt % of Si; up to but not more than about 1.0 wt % of Mn; from about 3.0 to 7.5 wt % of Cr; from about 4.5 to 6.5 wt % of Al; up to but not more than about 0.05 wt % of N; one or more elements selected from about the group consisting of 1), from about 0.01 wt % to 0.3 wt % of Zr, 2), from 0.01 wt % to 0.3 wt % of Ti, and 3), from about 0.001 wt % to 0.2 wt %, expressed as a total, of Y, La, Ce, Pr, Nd and Hf; and the balance sustantially Fe and incidental inclusions.

2 Claims, No Drawings

OXIDATION RESISTANT FE-CR-AL STEEL

BACKGROUND OF THE INVENTION

1. Field of the Invention

The present invention relates to an Fe-Cr-Al steel which is superior in workability, oxidation resistance, corrosion resistance and economy. More particularly, the present invention is concerned with an Fe-Cr-Al steel suitable for use as a material of members or structural parts which are subjected to a strong oxidizing environment or hot oxidizing atmosphere, e.g., parts of internal and external combustion systems, exhaust systems, boilers, incinerators and so forth.

2. Description of the Related Art

An oxidation resistant Fe-Cr-Al steel is disclosed in Japanese Patent Laid-Open Publication No. 63-45351 and also in the specification of U.S. Pat. No. 4,414,023. This steel contains 8 to 25 wt% of Cr and 3 to 8 wt% of Al. When this steel is used in a hot oxidizing atmosphere, Al in the steel is preferentially oxidized to form a fine protective film of $Al_2O_3$ so as to exhibit high resistance to oxidation. This oxidation resistant steel, therefore, is suitable for use in components of combustors or the like.

This known Fe-Cr-Al oxidation resistant steel, however, is still unsatisfactory from the view point of workability because, in general, the toughness of this steel is reduced when the Al content exceeds 3 wt%, with the result that surface defects are often caused during hot rolling. Surface grinding has to be conducted repeatedly to remove such surface defects.

In addition, sheets of this known steel tend to be ruptured when subjected to cold rolling. The rolling of this steel, therefore, has to be conducted at a low speed and reduction while elevating the temperature of the sheet.

Toughness of the steel can be improved by reducing the contents of Cr and Al as proposed in Japanese Patent Publications Nos. 54-35571 and 55-41290. Reduction of the Cr and Al contents, however, undesirably reduces the oxidation resistance to make the steel materially unusable at high temperatures exceeding 1000° C.

SUMMARY OF THE INVENTION

Accordingly, an object of the present invention is to provide an oxidation resistant Fe-Cr-Al steel which is superior in workability, oxidation resistance and corrosion resistance at high temperature, and economy, thereby overcoming the above-described problems of the prior art.

To this end, according to the present invention, there is provided an oxidation-resistant Fe-Cr-Al steel having a composition containing: up to but not more than about 0.05 wt% of C; up to but not more than about 1.0 wt% of Si; from about 0.1 wt. % to 1.0 wt% of Mn; from about 3.0 to 7.5 wt% of Cr; from about 4.5 to 6.5 wt% of Al; up to but not more than about 0.05 wt% of N; one or more elements selected from the group consisting of 1), from about 0.01 wt% to 0.3 wt% of Zr, 2), from about 0.01 wt% to 3.0 wt% of Ti, and 3), from about 0.001 wt% to 0.2 wt%, expressed as a total, of Y, La, Ce, Pr, Nd and Hf; and the balance substantially Fe and incidental inclusions.

The oxidation-resistant Fe-Cr-Al steel according to this invention can further contain from about 0.001 wt% to 0.05 wt% of Ca.

The inventors have found,through an intense study, that the toughness of an Fe-Cr-Al steel can be improved without reducing its oxidation resistance by adding to the steel material suitable amounts of Zr, Ti and rare earth elements, while reducing the Cr content. The present invention is accomplished on the basis of this knowledge.

A description will hereafter be given of the reasons for the importance of the contents of these elements. In the following description, the contents of the elements are stated in terms of weight percent (wt%).

C, N: not more than about 0.05 %

When the contents of C and N are excessively large, the toughness of the steel is lowered to seriously impair the cold workability of the steel. In addition, these elements tend to form compounds upon reaction with Cr and Al which are significant elements for maintaining required oxidation resistance, with the result that cleanliness is seriously impaired and that the yields of these significant elements are reduced. For these reasons, the content of each of C and N is limited to about 0.05 % or less.

Si: about 0.1 to 1.0%

Si is a important element as a deoxidizing agent and contributes to improvement in oxidation resistance. In order to obtain appreciable effects, the Si content should be not lower than about 0.1% by weight, as indicated in Table 1 which follows. Addition of this element in excess of about 1.0 % causes a reduction in toughness and seriously impairs cold workability. For this reason, the content of Si is limited to about 1.0 % or less.

Mn: not more than about 1.0 %

Mn also is an important deoxidizing element. An Mn content exceeding about 1.0 %, however, reduces the oxidation resistance. The Mn content is therefore limited to about 1.0 % or smaller.

Cr: about 3.0 to 7.5 %

Cr is an element which is essential for obtaininq required oxidation and corrosion resistances. In order to obtain appreciable effects the Cr content should be not lower than about 3.0 %. When the Cr content is too large, however, the toughness of the steel is reduced or impaired. The Cr content, therefore, should not exceed about 7.5 %.

Al: about 4.5 to 6.5 %

This element is one of the important elements in the steel of the present invention, as it improves oxidation resistance. In order to obtain a sufficiently large oxidation resistance, the content of this element should be not less than about 4.5 %. An excessive Al content, however, reduces the toughness of the steel to impair its cold workability. The Al content, therefore, is determined not to exceed about 6.5 %.

Ti: about 0.01 to 0.3 %

Ti provides a strong effect in making C and N inactive so as to suppress reduction of oxidation resistance and of cold workability caused by the presence of C and N. In addition, this element improves resistance to exfoliation of oxide scale in the presence of Cr and Al. Thus, this element also is one of the important elements in the steel of the present invention. In order to obtain a satisfactory result, the content of this element should be about 0.01 % or greater. An excessive Ti content, however, reduces the toughness of the steel to impair its cold workability. The Ti element, therefore, is determined not to exceed about 0.3 %.

Zr: about 0.01 to 0.3 %

Zr also improves resistance to exfoliation of oxide scale in the presence of Cr and Al so as to improve oxidation resistance of the steel and, hence, is one of the important elements in the steel of the present invention. In order to attain an appreciable effect, the content of this element should be not less than about 0.01 %. Too much Zr, however, tends to reduce oxidation resistance and reduces also the toughness of the steel to impair its cold workability. The Zr content therefore is determined so as not to exceed about 0.3 %.

Y, La, Ce, Pr, Nd, Hf: about 0.001 to 0.2 % expressed as a total

As in the cases of Ti and Zr, these elements improve resistance to exfoliation of oxide scale in the presence of Cr and Al so as to improve oxidation resistance of the steel and, hence, are important elements in the steel of the present invention. In order to obtain a satisfactory result, the total content of these elements has to be not less than about 0.001 %. However, an excessive total content of these elements reduces toughness due to presence of inclusions, with the result that cold workability of the steel is impaired undesirably. For this reason, the total content of these elements is determined so as not to exceed about 0.2 %.

Ca: about 0.001 to 0.05 %

Ca is effective in nullifying the effect of S which seriously impairs oxidation resistance of the steel. This element is therefore added as required in an amount not less than about 0.001 %. In the steel of the present invention, Ca cannot exist as a solid solution when its content exceeds about 0.05 %. For these reasons, therefore, the Ca content is determined to lie within the range from about 0.001 to 0.05 %. Although no limitation is imposed on the S content, it is preferred that the S content shall not exceed about 0.005 % from the view point of oxidation resistance.

The aforementioned known Fe-Cr-Al steel with reduced Al content can maintain the required level of oxidation resistance only at a comparatively low temperature, e.g., up to 900° C. Adjustments of contents of Cr and Al to the claimed ranges is not sufficient for attaining the required oxidation resistance at high temperatures exceeding 1000° C. Namely, in order to attain the required level of oxidation resistance at such high temperatures, it is also necessary that at least one of Ti, Zr and one or more of Y, La, Ce, Pr, Nd and Hf shall be present in the amounts specified in the claim.

EXAMPLE

Compositions of Examples of the steel of the present invention are shown in Table 1, while compositions of Comparison Examples of steel are shown in Table 2. The steels of the compositions shown in Tables 1 and 2 were formed into ingots of 10 kg and, after being heated to 1200° C., hot rolled to sheets 3 mm thick. A Charpy test was conducted on these sheets to examine the levels of toughness. The results of the Charpy test also are shown in Tables 1 and 2. The sheets also were subjected to an annealing conducted at 900° C. for 1 minute for the descaling purpose. Samples of the steel sheets exhibiting impact absorption energy of 5 kgf·m/cm$^2$ at 25° C. were rolled to sheets of 0.5 mm at an elevated temperature of 100° C., since cold rolling of such samples was difficult. Other samples exhibiting impact absorption energy of 5 kgf·m/cm$^2$ or higher under the same conditions could be cold-rolled to sheets of 0.5 mm thick.

These sheets were then subjected to annealing and surface grinding, and test pieces 20 mm wide and 30mm long were extracted from these sheets for the purpose of oxidation testing. Test pieces 50mm wide and 100 mm long also were extracted for the purpose of corrosion testing.

The oxidation tests were conducted by holding the test pieces for 96 hours in an electric oven maintaining an atmosphere of 1150° C. and then measuring increments of weight of the test pieces, the results being shown in Tables 1 and 2.

The corrosion tests were conducted by executing a 24-hour salt spray test to examine the state of generation of rust. The results are shown in Tables 1 and 2.

In Tables 1 and 2, the test items were evaluated on the following bases.

Toughness: Impact absorption energy as measured by the Charpy test on hot-rolled sheets (kgf·m/cm$^2$)

Oxidation resistance: Weight increment due to oxidation after 96-hour shelving in an atmosphere of 1150° C.

Corrosion resistance: Result of 24-hour salt spray test at 35° C. (marks O and X are respectively applied to samples which did not show rust and which did exhibit rust after the spray test)

From Tables 1 and 2, it is clearly understood that steels having compositions falling within the ranges specified by the invention exhibit superior workability, and high resistance to both oxidation and corrosion at high temperature.

As will be understood from the foregoing description, the present invention provides an oxidation resistant steel which is superior in workability, oxidation resistance and corrosion resistance at high temperature.

TABLE 1

| Symbol | C | Si | Mn | Cr | Al | N | Ti | Zr | Y, La, Ce, Pr, Nd, Hf | Ca | Toughness *1) | Weight increment (mg/cm$^2$) | Corrosion resistance | Evaluation |
|---|---|---|---|---|---|---|---|---|---|---|---|---|---|---|
| A1 | 0.03 | 0.6 | 0.2 | 3.4 | 6.2 | 0.006 | | 0.1 | | | 5.0 | 1.4 | O | O |
| A2 | 0.02 | 0.2 | 0.1 | 6.2 | 5.0 | 0.01 | | 0.04 | | | 7.5 | 1.2 | O | O |
| A3 | 0.01 | 0.4 | 0.5 | 8.7 | 4.7 | 0.02 | | 0.3 | | | 6.0 | 1.1 | O | O |
| A4 | 0.004 | 0.8 | 0.2 | 5.0 | 5.9 | 0.01 | 0.05 | 0.1 | | | 7.5 | 1.2 | O | O |
| A5 | 0.03 | 0.2 | 0.1 | 6.4 | 6.2 | 0.02 | 0.2 | | | | 6.5 | 1.5 | O | O |
| A6 | 0.01 | 0.2 | 0.2 | 3.5 | 4.9 | 0.03 | | | Ce: 0.08 | | 6.0 | 1.1 | O | O |
| A7 | 0.005 | 0.6 | 0.4 | 8.5 | 6.0 | 0.007 | | 0.2 | La: 0.04, Ce: 0.07 | | 12.6 | 1.2 | O | O |
| A8 | 0.01 | 0.4 | 0.3 | 3.8 | 5.5 | 0.02 | | | La: 0.08, Ce: 0.01, Pr: 0.005 | | 5.0 | 1.3 | O | O |

TABLE 1-continued

| Symbol | C | Si | Mn | Cr | Al | N | Ti | Zr | Y, La, Ce, Pr, Nd, Hf | Ca | Toughness *1) | Weight increment (mg/cm²) | Corrosion resistance | Evaluation |
|---|---|---|---|---|---|---|---|---|---|---|---|---|---|---|
| A9 | 0.03 | 0.1 | 0.2 | 5.5 | 5.1 | 0.01 | | | Y: 0.18 | | 5.5 | 0.9 | O | O |
| A10 | 0.02 | 0.2 | 0.2 | 7.2 | 4.9 | 0.01 | | 0.04 | Nd: 0.02, Hf: 0.01 | 0.0052 | 5.5 | 1.8 | O | O |
| A11 | 0.02 | 0.2 | 0.2 | 8.5 | 5.5 | 0.01 | 0.07 | | La: 0.03, Y0.10 | | 7.0 | 1.2 | O | O |
| A12 | 0.008 | 0.1 | 0.2 | 6.6 | 5.1 | 0.007 | 0.05 | 0.12 | La: 0.09 | 0.0035 | 10.5 | 1.1 | O | O |

*1) Toughness is shown in terms of impact absorption (kgf · m/cm²)

TABLE 2

| Symbol | C | Si | Mn | Cr | Al | N | Ti | Zr | Y, La, Ce, Pr, Nd, Hf | Ca | Toughness *1) | Weight increment (mg/cm²) | Corrosion resistance | Evaluation |
|---|---|---|---|---|---|---|---|---|---|---|---|---|---|---|
| B1 | 0.04 | 0.9 | 0.2 | 3.1 | 3.5 | 0.01 | | 0.46 | | | 15.0 | 72 | X | X |
| B2 | 0.01 | 0.3 | 0.3 | 8.5 | 5.0 | 0.02 | 0.2 | | La: 0.03, Ce: 0.07 | | 0.5 | 1.0 | O | X |
| B3 | 0.02 | 0.3 | 0.3 | 6.5 | 5.2 | 0.01 | | | | 0.0055 | 2.1 | 18 | O | X |
| B4 | 0.01 | 0.7 | 0.2 | 9.1 | 2.1 | 0.01 | 0.2 | | | | 1.5 | 65 | X | X |
| B5 | 0.01 | 0.4 | 0.1 | 2.3 | 5.2 | 0.02 | | | Ce: 0.04 | 0.0051 | 7.0 | 45 | X | X |
| B6 | 0.02 | 0.4 | 0.3 | 6.6 | 4.0 | 0.02 | 0.1 | 0.1 | La: 0.01, Ce: 0.02 | | 8.5 | 15 | X | X |
| B7 | 0.01 | 0.3 | 0.3 | 6.1 | 6.9 | 0.01 | | 0.02 | | | 0.5 | 1.4 | O | X |
| B8 | 0.01 | 0.6 | 0.1 | 10.3 | 5.6 | 0.02 | | 0.2 | | | 1.5 | 1.7 | O | X |
| B9 | 0.10 | 0.4 | 0.2 | 5.8 | 4.9 | 0.01 | 0.2 | 0.1 | | | 2.5 | 18 | O | X |
| B10 | 0.02 | 1.8 | 0.3 | 6.0 | 5.1 | 0.02 | 0.2 | | Y: 0.08 | | 0.5 | 5.6 | O | X |
| B11 | 0.02 | 0.4 | 0.2 | 5.9 | 5.2 | 0.02 | | 0.4 | | | 6.5 | 8.9 | O | X |
| B12 | 0.02 | 0.2 | 0.2 | 5.7 | 5.1 | 0.01 | 0.5 | | | | 2.5 | 9.4 | O | X |
| B13 | 0.02 | 0.2 | 0.1 | 6.2 | 4.7 | 0.02 | | | | | 7.0 | 37 | O | X |
| B14 | 0.01 | 0.3 | 0.1 | 6.4 | 5.5 | 0.02 | | | La: 0.22 | | 0.5 | 0.9 | O | X |

*1) Toughness is shown in terms of impact absorption (kgf · m/cm²)

What is claimed is:

1. An oxidation-resistant Fe-Cr-Al steel comprising: u to but not more than about 0.05 wt% of C; from about 0.1 wt% to about 1.0 wt% of Si; up to but not more than about 1.0 wt% of Mn; from about 3.0 to 7.5 wt% of Cr; from about 4.5 to 6.5 wt% of Al; up to but not more than about 0.05 wt% of N; one or more elements selected from the group consisting of 1), from about 0.01 wt% to 0.3 wt% of Zr, 2), from about 0.01 wt% to 0.03 wt% of Ti, and 3), from about 0.001 wt% to 0.2 wt%, expressed a sa total , of Y, La, Ce, Pr, Nd and Hf; and the balance substantially Fe and incidental inclusions.

2. An oxidation-resistant Fe-Cr-Al steel according to claim 1, further containing from about 0.001 wt% to 0.05 wt% of Ca.

* * * * *

UNITED STATES PATENT AND TRADEMARK OFFICE

CERTIFICATE OF CORRECTION

PATENT NO. : 5,085,829

DATED : 2/4/92

INVENTOR(S) : Kazuhide Ishii et al

It is certified that error appears in the above-identified patent and that said Letters Patent is hereby corrected as shown below:

Column 1, line 57, please change "from about 0.1 wt.% to" to --up to but not more than about--.

Signed and Sealed this

Thirtieth Day of November, 1993

Bruce Lehman

*Attest:*

BRUCE LEHMAN

*Attesting Officer*

*Commissioner of Patents and Trademarks*